US007201591B2

(12) United States Patent
Fujii

(10) Patent No.: US 7,201,591 B2
(45) Date of Patent: Apr. 10, 2007

(54) LEVER-TYPE CONNECTOR

(75) Inventor: Masayasu Fujii, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/215,700

(22) Filed: Aug. 30, 2005

(65) Prior Publication Data

US 2006/0051994 A1 Mar. 9, 2006

(30) Foreign Application Priority Data

Sep. 6, 2004 (JP) ..... 2004-258358

(51) Int. Cl.
*H01R 13/52* (2006.01)

(52) U.S. Cl. ..... 439/157

(58) Field of Classification Search ..... 439/157, 439/155, 310, 372; 285/26, 226, 320
See application file for complete search history.

(56) References Cited

U.S. PATENT DOCUMENTS 5,401,179 A * 3/1995 Shinchi et al. ..... 439/157
5,484,297 A * 1/1996 Takahashi et al. ..... 439/157
5,695,349 A * 12/1997 Taguchi et al. ..... 439/157
5,709,560 A * 1/1998 Hio ..... 439/157
6,319,050 B1 * 11/2001 Miyazaki et al. ..... 439/489
2002/0182491 A1 * 12/2002 Maegawa ..... 429/157

FOREIGN PATENT DOCUMENTS

JP 2003-223958 8/2003

* cited by examiner

*Primary Examiner*—Alexander Gilman
(74) *Attorney, Agent, or Firm*—Gerald E. Hespos; Anthony J. Casella

(57) ABSTRACT

A female housing (10) has a tubular fit-in part (11) and a male housing (30) has a hood (31) that can enter the tubular fit-in part (11) to allow both housings (10, 30) to reach a proper connection. A lever (50) is mounted rotatably on the female housing (10) and engages a cam pin (33) on the female housing (30) to move the housings together. A locking part (60) is provided on the lever (50) and a locking projection (36) is provided on the hood (31). The locking part (60) locks to the locking projection (36) through a window (16) formed on the tubular fit-in part (11) when the lever (50) is rotated to a predetermined normal position. Thus, proper connection of the male housing (30) with the female housing (10) is ensured by the locking of the lever (50).

6 Claims, 6 Drawing Sheets

LEVER-TYPE CONNECTOR

BACKGROUND OF THE INVENTION

1. Field of the Invention

The invention relates to a lever-type connector.

2. Description of the Related Art

Japanese Patent Application Laid-Open No. 2003-223958 discloses a connector assembly that uses a lever to exert the force required for mating a male connector and a female connector. The female connector has a female housing with a hood and female terminals are mounted in the female housing. A wire cover is mounted on the female housing, and the shaft of the lever is supported rotatably on the wire cover. The lever has a cam groove that engages a cam pin on the male connector. The lever is set at an initial position with the cam groove facing the cam pin. The male connector then is fit loosely in the hood of the female housing so that the cam pin enters the cam groove. The lever then is rotated so that the cam pin travels along the cam groove. Thus, a cam action moves the connectors to a normal fit-in position. A locking projection is provided on the wire cover and can engage an operation portion of the lever to prevent the connectors from being separated.

The operation portion of the lever can engage the locking projection in the above-described lever-type connector, even though the male housing is inclined during insertion into the hood. Therefore, locked engagement of the lever provides no assurance that the fittings have been connected properly, and it is difficult to detect whether the connectors have reached the normal fit-in position.

The invention has been completed in view of the above-described situation, and it is an object of the invention to provide a lever-type connector that ensures that the connectors have been locked together properly.

SUMMARY OF THE INVENTION

The invention relates to a lever-type connector with a first housing that has a hood and a second housing that can fit in the hood. A lever is mounted rotatably on one of the housings and has a cam groove. The other housing has a cam pin for engaging the cam groove. Rotation of the lever generates a cam action between the cam groove and the cam pin for urging the second housing into the hood. A lock is provided on the lever and a lock-receiving portion is provided on the other housing at an exposed position that is not covered with the hood. The lock engages the lock-receiving portion when the lever is rotated to a predetermined normal position.

The hood preferably has a window for exposing the lock-receiving portion that has penetrated into the hood. The lock is locked to the lock-receiving portion through the window.

The first housing preferably has a body surrounded by the hood and the second housing preferably has a mating hood that can be fit in a gap between the body and the hood of the first housing.

The lock-receiving portion is exposed through the hood. Therefore, an operator can confirm that the housings have reached a predetermined normal fit-in position. Additionally, the housings are locked together merely by rotating the lever sufficiently for the lock of the lever to engage the lock-receiving portion.

The lock-receiving portion and the lock of the lever are locked to each other through the window. Therefore, the locking construction is formed inside the fit-in region of both housings. Accordingly, the lever can be compact and the space outside the fit-in region is utilized efficiently.

The lever is operated after fitting the mating hood in the gap between the body and the hood of the first housing. Therefore the second housing is kept in a stable posture and the fit-in operation is performed reliably.

DETAILED DESCRIPTION OF THE PREFERRED EMBODIMENTS

A connector according to the invention has a female housing 10 and a male housing 30 that can fit in the female housing 10, as shown in FIGS. 1 through 7. A lever 50 is provided on the female housing 10 for urging the male housing 30 into the female housing 10. In the following description, the fit-in side of each housing 10, 30 is referred to as the front.

Figure 1:
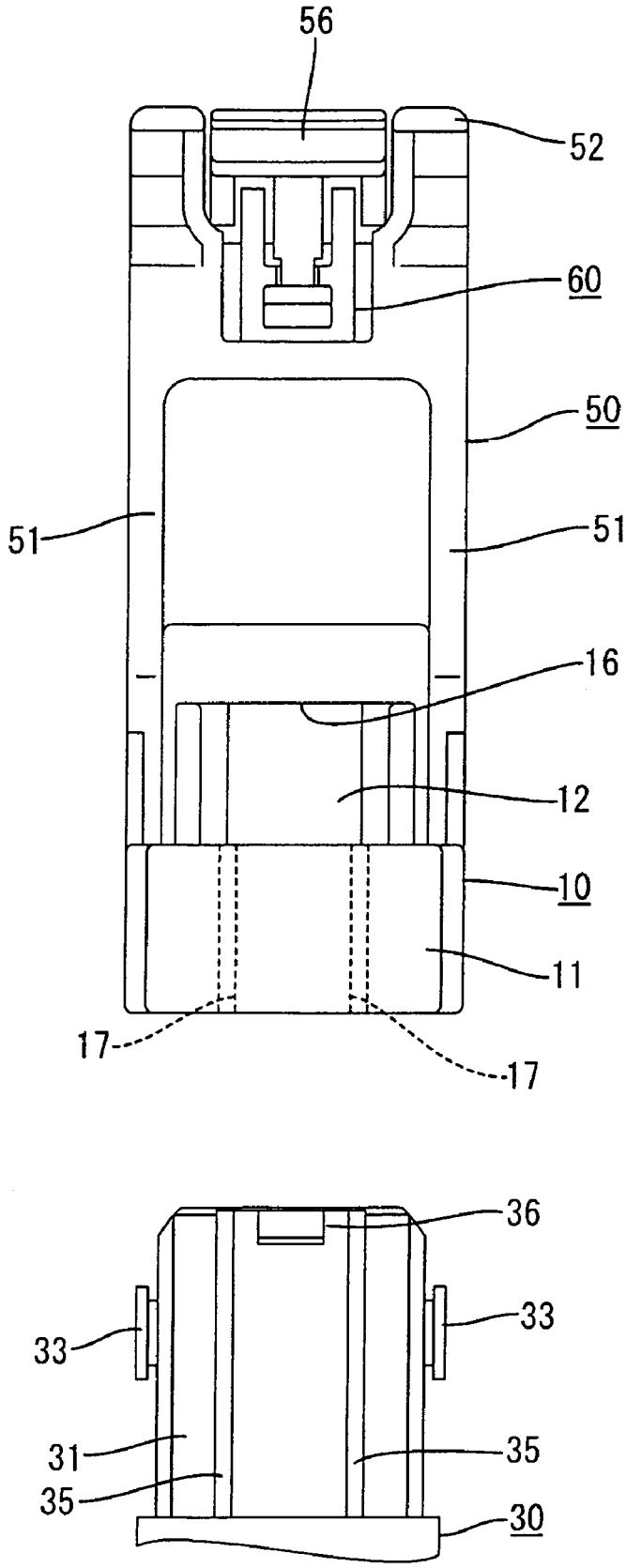
FIG. 1 is a plan view showing a state in which both housings are separated from each other.
Figure 2:
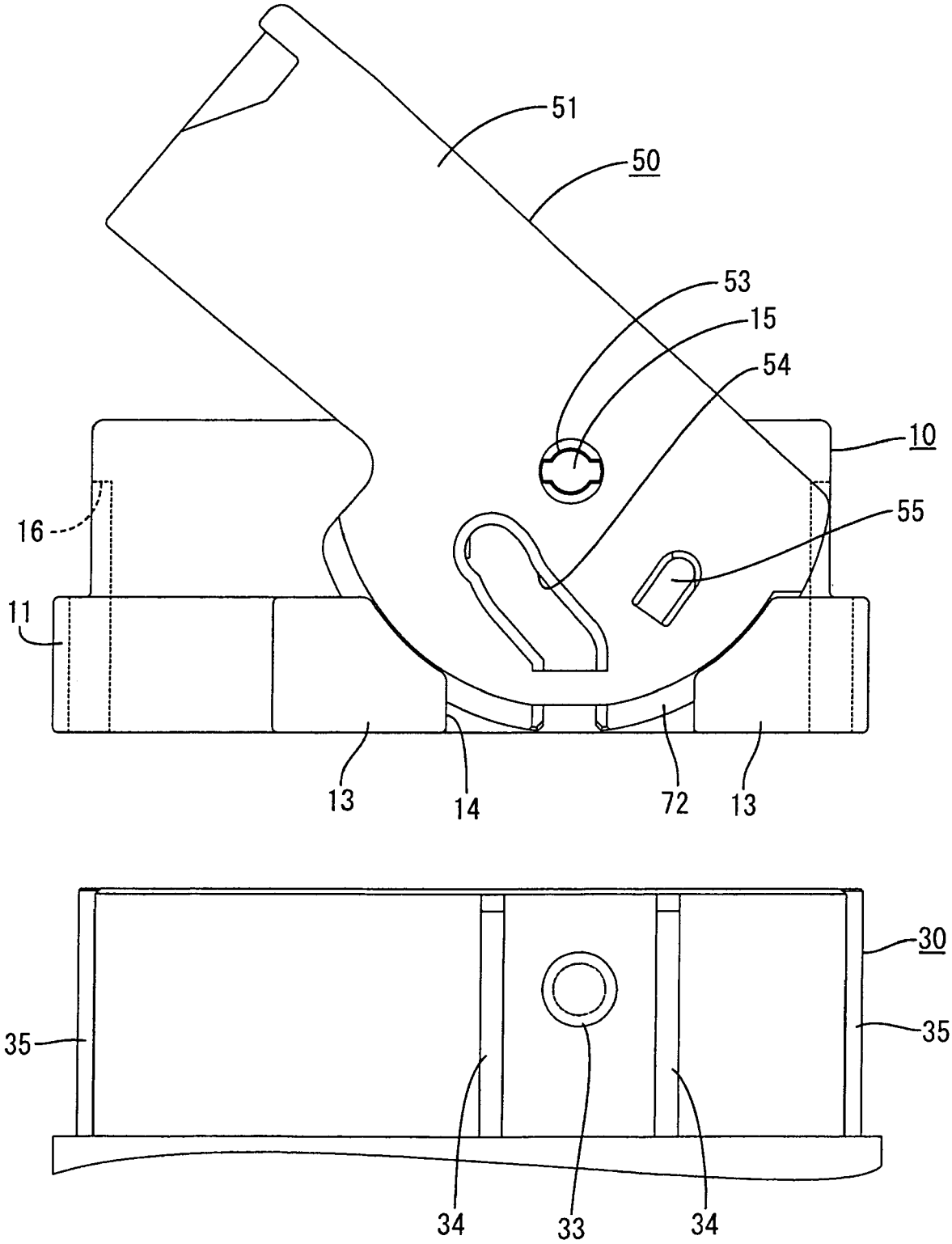
FIG. 2 is a side view showing the state in which both housings are separated from each other.
Figure 6:
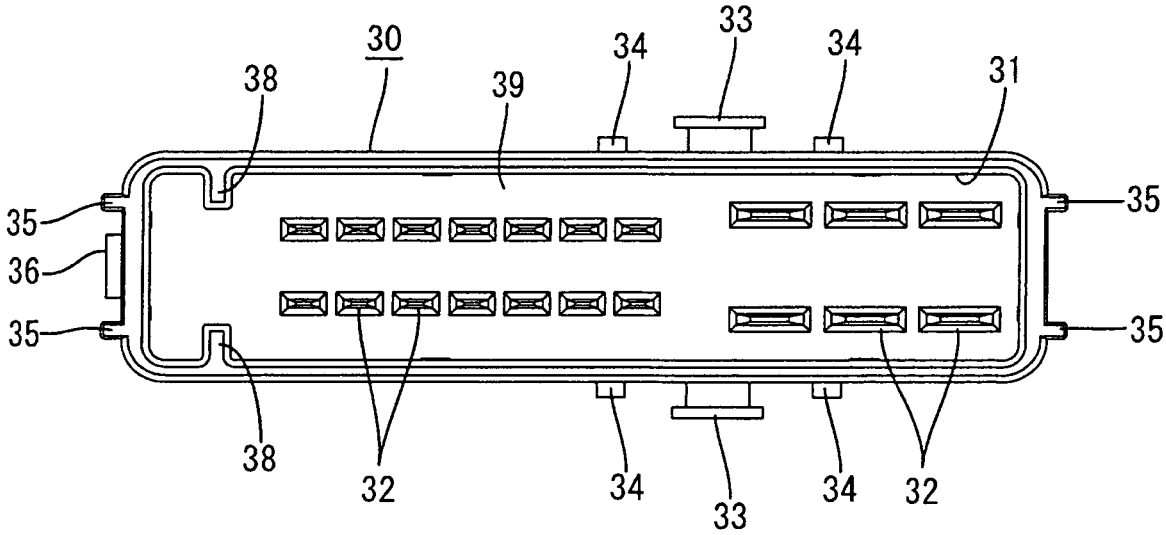
FIG. 6 is a front view showing a male housing.

The male housing 30 is made of synthetic resin, and a has a substantially rectangular tubular hood 31 that opens to the front, as shown in FIGS. 1, 2 and 6. The hood 31 is wide in a direction orthogonal to the mating direction of the male housing 30 with the female housing 10, and an inner wall 39 extends transversely across the rear end of the hood 31. Male terminal fittings are mounted in the male housing 30 behind the inner wall 39 and tabs 32 of the male terminal fittings project forwardly through the inner wall 39 and into the hood 31. The tabs 32 are disposed in rows that extend in the width direction.

Figure 3:
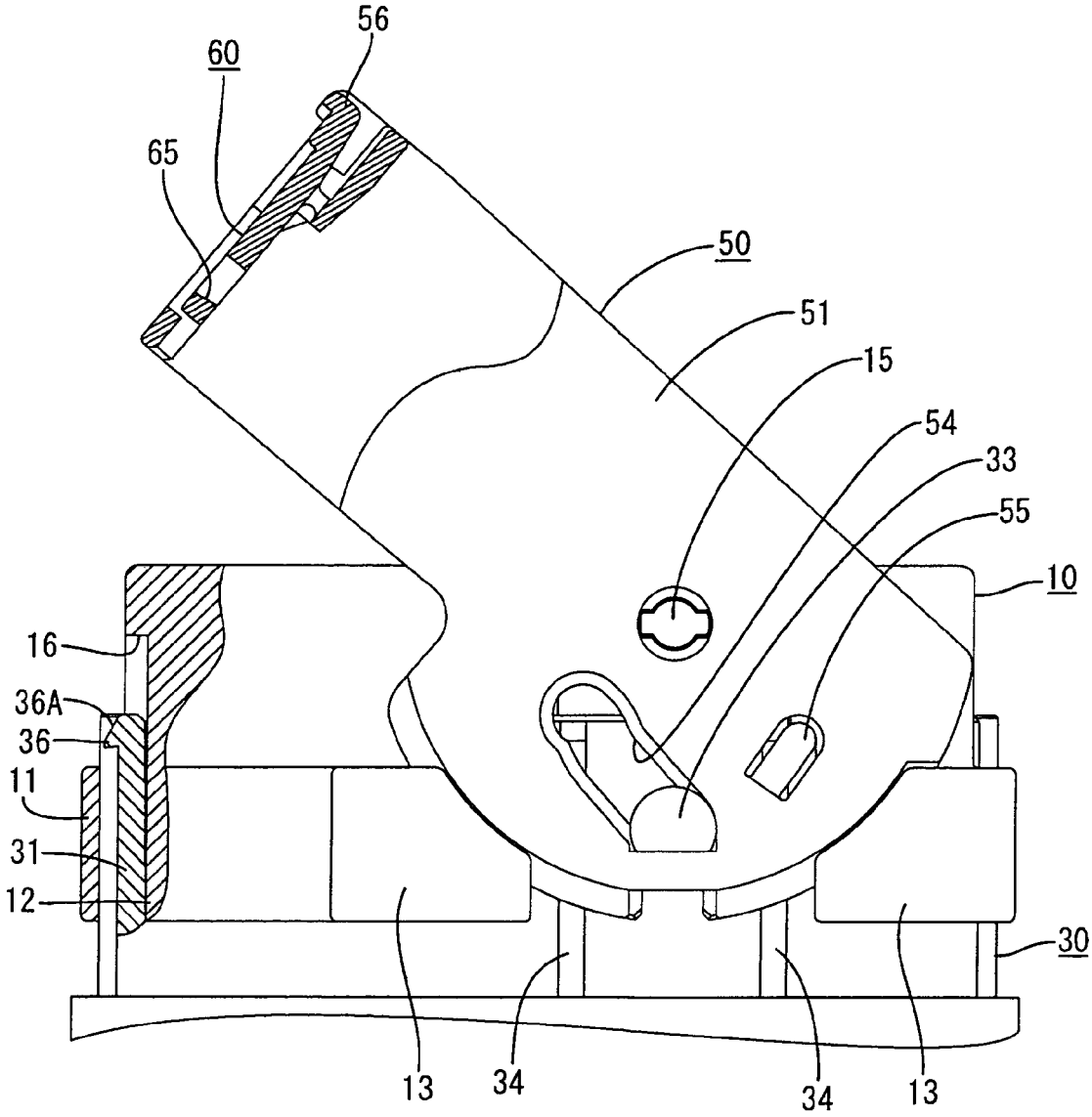
FIG. 3 is a side view in which main portions are broken-away, showing a state in which both housings are disposed at an initial fit-in position.

Columnar cam pins 33 project out from the longer sides of the hood 31 and unlocking ribs 34 extend in the longitudinal direction of the male housing 30 on opposite sides of each cam pin 33. Two guide ribs 35 are formed on the outer surfaces of each of the shorter sides of the hood 31 and extend in the longitudinal direction of the male housing 30. A lock 36 projects from the outer surface of one of the shorter sides of the hood 31. The lock 36 is between the guide ribs 35 on the respective shorter side of the hood 31 and is substantially at the front end of the male housing 30. A tapered face 36A slopes out and back at the front of the lock 36, as shown in FIG. 3. Two erroneous fit-in prevention ribs 38 are formed respectively on the inner surfaces of the longer sides of the hood 31 near one of the shorter sides of the hood 31, as shown in FIG. 6.

The female housing 10 also is made of synthetic resin and has a wide block-shaped body 12 capable of accommodating female terminal fittings (not shown). Electric wires (not shown) are connected with the female terminal fittings and are drawn out in a bundle from the rear surface of body 12.

A tubular fit-in part 11 surrounds the periphery of the body 12. The tubular fit-in part 11 is open forward and is configured so that the hood 31 of the male housing 30 can fit into the space between the outer surface of the body 12 and the tubular fit-in part 11. Substantially parallel left and right expansion prevention walls 13 are spaced out from the longer outer side surfaces of the tubular fit-in part 11. Thereby it is possible to prevent expansion deformation of the lever 50 due to resistance generated by the operation of fitting the male housing 30 in the female housing 10. A cut-out 14 is formed between the expansion prevention walls 13 and opens on a front edge of the tubular fit-in part 11. The cam pin 33 and the unlocking ribs 34 of the male housing 30 penetrate into the cut-out 14 from the front of the female housing 10 when the female and male housings 10 and 30 are mated.

Two shafts 15 for rotatably supporting the lever 50 project from the longer outer side faces of the tubular fit-in part 11. As shown in FIG. 3. The shafts 15 are at positions spaced at a short interval from approximately the center in the widthwise direction of the tubular fit-in part 11. A window 16 is formed on each shorter outer side faces of the tubular fit-in part 11. Each window 16 is approximately rectangular with the entire peripheries thereof closed. Additionally, each window 16 is wider than the body 12. Therefore one of the shorter outer side faces of the body 12 is exposed through the window 16 before the male housing 30 is fit in the female housing 10. Two guide grooves 17 are formed on the inner surface of each shorter side of the tubular fit-in part 11 and extend in the longitudinal direction of the tubular fit-in part 11. As shown in FIG. 1, the guide ribs 35 of the male housing 30 can fit in the guide groove 17 when the male housing 30 is fit in the female housing 10. Thus, the male housing 30 can be fit smoothly in the female housing 10 when the housings 10, 30 are in a normal confronting posture.

The lever 50 is made of synthetic resin and defines a gate shape. More particularly, the lever 50 has two plate-shaped arms 51 and an operation portion 52 that extends in the width direction of the female housing 10 between the arms 51. A bearing 53 is formed on each arm 51 and is configured to fit on the shaft 15. A cam groove 54 also is formed on each arm 51 and defines an approximately circular arc. An entrance of each cam groove 54 opens on a periphery of the arm 51. A thin fit-in portion 72 is formed on a peripheral edge of the arm 51 and is dimensioned to penetrate into a gap between the expansion prevention wall 13 and the peripheral surface of the body 12 to prevent expansion deformation of the lever 50 due to resistance generated while fitting the male housing 30 into the female housing 10. The fit-in portion 72 defines a circular arc that is concentric with the bearing 53 and the entrance of the cam groove 54 is midway in the fit-in portion 72.

Figure 4:
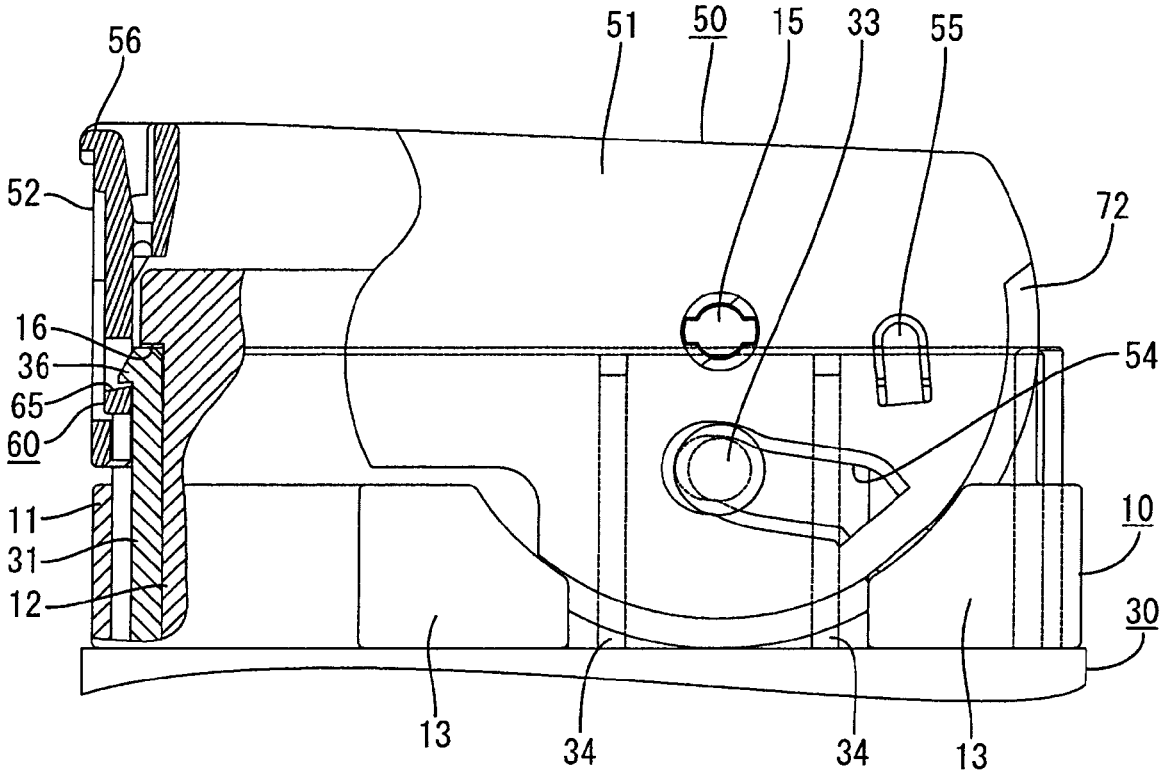
FIG. 4 is a side view in which main portions are broken-away, showing a state in which both housings are disposed at a finished fit-in position.

The lever 50 can be rotated between an initial rotational position and a fit-in position. The entrance of the cam groove 54 opens forward through the cut-out 14 of the tubular fit-in part 11 when the lever 50 is at the initial position. Thus, the cam pin 33 of the male housing 30 can be received in the entrance of the cam groove 54 by fitting the male housing 30 slightly in the female housing 10. The cam pin 33 moves in the cam groove 54 to draw the housings 10, 30 together as the lever 50 is rotated from the initial position. In this manner, the male housing 30 is urged into the female housing 10, and reaches a predetermined normal state in the female housing 10, as shown in FIG. 4.

Elastic locking pieces 55 are cantilevered on the respective arms 51. Each elastic locking piece 55 has a projection (not shown) formed inward from a front end thereof. The projection of the elastic locking piece 55 is locked to an inner edge of the cut-out 14 of the tubular fit-in part 11 to hold the lever 50 at the initial position when the male housing 30 has not been fit in the female housing 10. On the other hand, the projection is pressed out by the unlocking rib 34 of the male housing 30 when the male housing 30 has been fit in the female housing 10, as shown in FIG. 3. Thus, the projection is unlocked from the inner edge of the cut-out 14 to permit rotation of the lever 50 to the fit-in finished position.

Figure 7:
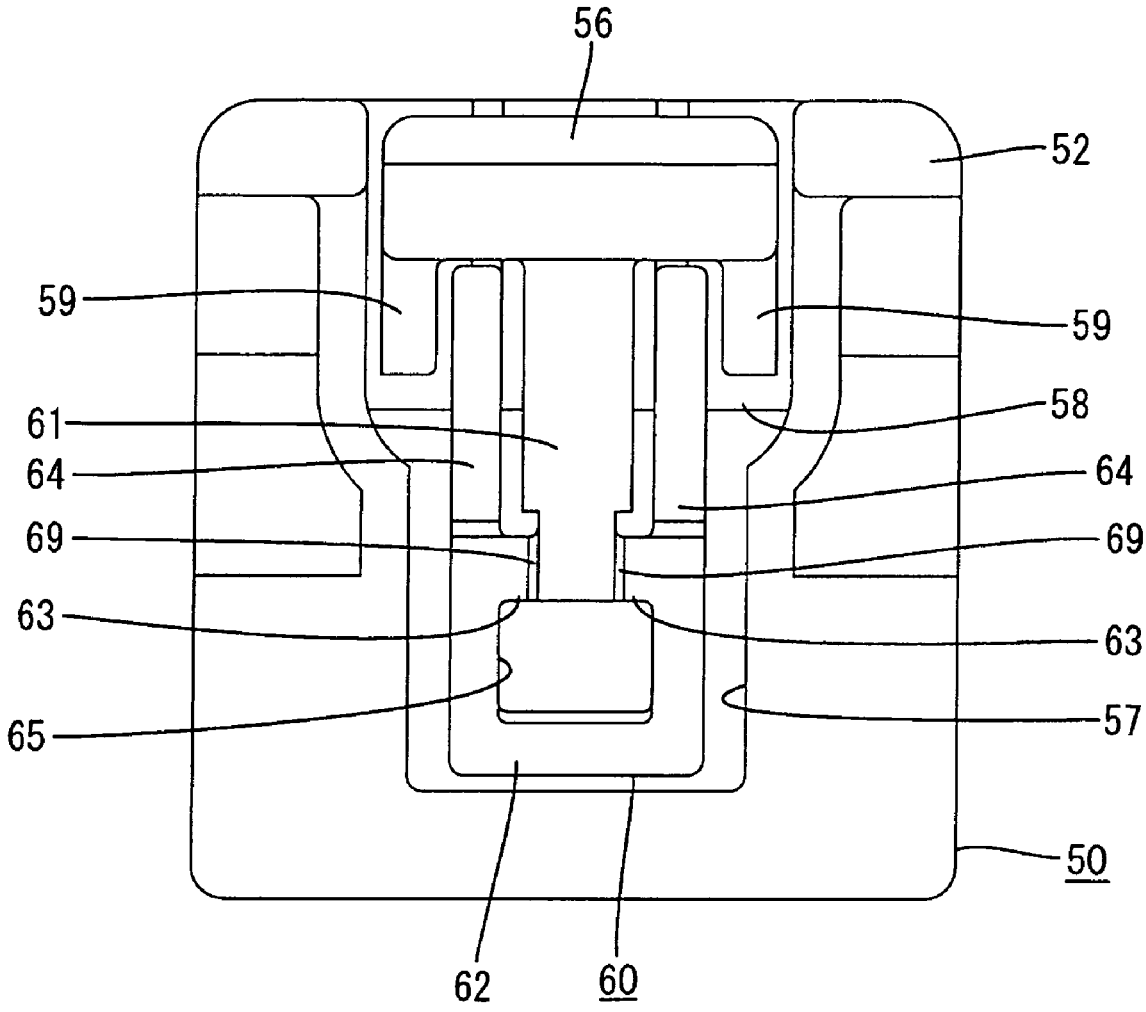
FIG. 7 is a plan view showing a lever.

As shown in FIG. 7, the operation portion 52 of the lever 50 has a locking part 60 to which the locking projection 36 of the male housing 30 can be locked elastically when the lever 50 is at the fit-in finished position. The locking part 60 is disposed inside a flexible space 57 formed by cutting out the operation portion 52. The locking part 60 includes a base 58 that spans the flexible space 57. Two legs 59 curve rearward, and roots of the legs 59 connect with the outer ends of the base 58. A finger-applying portion 56 spans between the legs 59, and a lock 61 projects forward from approximately a central widthwise position of the finger-applying portion 56. Two release pieces 69 project from a front end of the locking piece 61 at positions near the left and right sides thereof. The locking part 60 further includes a U-shaped frame 62. Roots of the frame 62 are connected with inner ends of the base 58 and projected ends are connected to one another. The locking part 60 further includes two interlocking pieces 63 that project in from the projected pieces 64 of the frame 62 at positions above both release pieces 69.

The locking projection 36 of the hood 31 is exposed through the window 16 of the tubular fit-in part 11 when the lever 50 is at the initial rotational position with the male housing 30 fit slightly in the female housing 10. The locking projection 36 moves into the tubular fit-in part 11 when the lever 50 is rotated towards the fit-in finished position in this state, and the operation portion 52 approaches the locking projection 36 due to the rotation of the lever 50. The frame 62 of the locking part 60 rides across the locking projection 36 immediately before the lever 50 reaches the fit-in finished position. Thus, the frame 62 deforms elastically and slides along a tapered surface. The frame 62 of the locking part 60 rides across the locking projection 36 and restores elastically to its original state when the lever 50 reaches the fit-in finished position. Thus, the locking projection 36 fits into the fit-in space 65 surrounded by the frame 62 and the locking piece 61. Accordingly, locking projection 36 is locked in position longitudinally and widthwise. In this state, the hood 31 and the tubular fit-in part 11 overlap each other in their thickness directions, and the locking projection 36 and the locking part 60 define a locking construction on a portion where the hood 31 and the tubular fit-in part 11 overlap.

To unlock the lever 50 from the locking projection 36, the finger-applying portion 56 is pressed down. This downward pressing of the finger-applying portion 56 lifts the release piece 69 and the interlocking piece 63. The lifting of the interlocking piece 63 lifts the front side of the frame 62 up. The locking part 60 is unlocked from the locking projected portion 36 by applying a force in a direction in which the housings 10, 30 are separated from each other. The tubular fit-in part 11 has a color different from the hood 31 so that an operator can clearly see that the hood 31 has entered the window 16.

The connector is assembled by mounting the lever 50 on the tubular fit-in part 11 of the female housing 10. The lever 50 is held at the initial rotational position by locking the elastic locking piece 55 to the cut-out 14 of the tubular fit-in part 11. The male housing 30 then is fit slightly into the gap between the body 12 and the tubular fit-in part 11 of the female housing 10, as shown in FIG. 3. As a result, the cam pin 33 enters the cam groove 54. Simultaneously, the unlocking rib 34 of the male housing 30 unlocks the tubular fit-in part 11 from the elastic locking piece 55 and the locking projection 36 at the front end of the hood 31 penetrates into the window 16. The erroneous fit-in prevention rib 38 on the hood 31 will contact the front end face of the body 12 if the male housing 30 is oriented improperly to prevent further fit-in. Thus, the male housing 30 is prevented from being mounted erroneously in the female housing 10.

Figure 5:
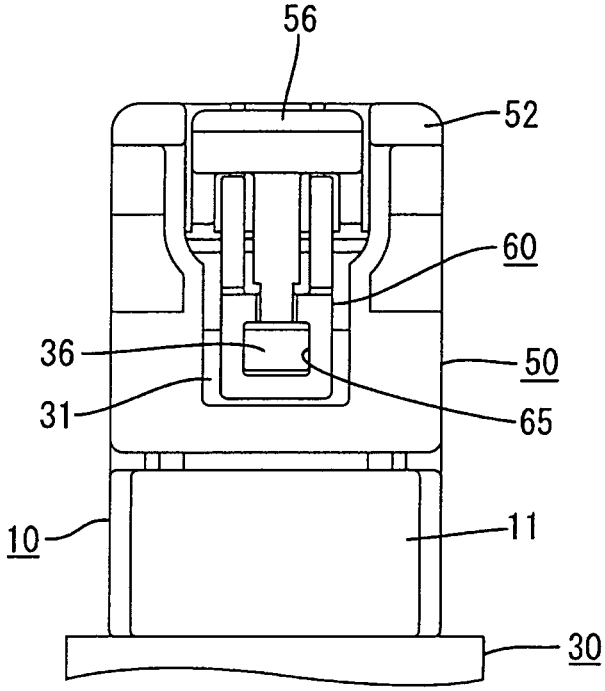
FIG. 5 is a plan view showing a state in which both housings are at the finished fit-in position.

The operating portion 52 of the lever 50 can be held to rotate the lever 50 towards the fit-in finished position. The guide rib 35 slides along the guide groove 17 as the lever 50 is rotated, and the hood 31 of the male housing 30 is fit into the gap between the tubular fit-in part 11 and the body 12 of the female housing 10. Thus, both housings 10, 30 are held in a predetermined normal posture in the fit-in process. The locking projection 36 moves rearward in the window 16 as the fit-in depth of the male housing 30 increases. The locking projection 36 confronts the rear edge of the window 16 and is locked elastically to the locking part 60 of the lever 50 when the lever 50 reaches the fit-in finished position, as shown in FIGS. 4 and 5. Thus, the lever 50 is prevented from rotating in a return direction. In this manner, both housings 10, 30 are locked together in the normal fit-in state.

To separate the housings 10, 30 from each other, the finger-applying portion 56 of the locking part 60 is pressed down to lift the interlocking piece 63 and to release the locking projection 36 from the fit-in space 65. The lever 50 then is rotated in the return direction and the cam action between the cam groove 54 and the cam pin 33 separates the housings 10, 30 from each other.

As described above, the locking part 60 of the lever 50 is locked to the locking projection 36 of the male housing 30 when the lever 50 is rotated to the fit-in finished position. Therefore, a locking construction is formed between the housings 10, 30 as the male housing 30 is fit in the tubular fit-in part 11 of the female housing 10. The locking projection 36 that is locked to the locking part 60 is exposed and is not covered with the tubular fit-in part 11. This allows the operator to confirm that both housings 10, 30 have reached the normal fit-in position.

The tubular fit-in part 11 has the window 16 for exposing the locking projection 36 that has penetrated into the tubular fit-in part 11. The locking projection 36 is locked to the locking part 60 through the window 16. Therefore, the locking construction is formed inside the fit-in region of the housings 10, 30. Accordingly, the lever 50 is compact and space is utilized efficiently.

The invention is not limited to the embodiment described above with reference to the drawings. For example, the following embodiments are included in the technical scope of the present invention. Further, various modifications of the above-described embodiment can be made without departing from the spirit and scope of the present invention.

The locking part is flexible in the above-described embodiment. However, the locking-receiving portion may be flexible.

The locking part and the locking-receiving portion are locked together inside the fit-in region of both housings in the above-described embodiment. However, the locking part and the locking-receiving portion may be locked together outside the fit-in region. In this case, the locking part should be constructed by overhanging a part of the lever to the mating housing.

The above-described lever is mounted on the female housing, and the cam pin is on the male housing. However, the lever may be mounted on the male housing and the cam pin may be on the female housing.

What is claimed is:

1. A lever-type connector comprising:

a first housing with a front end and a hood open at the front end of the first housing and a window formed through the hood at a location spaced rearwardly from the front end of the first housing;

a second housing with a front end configured for insertion into the hood, a locking-receiving portion substantially adjacent the front end of said second housing and exposed at the window when the second housing is inserted into the hood; and a lever mounted rotatably on one of the housings and having a cam groove configured to generate a cam action for moving said housings into a predetermined fit-in position as said lever is rotated, a locking part formed on said lever and configured for locking to the locking-receiving portion at the window when said lever is rotated to a predetermined normal position.

2. The lever-type connector of claim 1, wherein the second housing includes erroneous connection preventing structures for engaging the first housing and permitting connection only when the housings are oriented properly.

3. The lever-type connector of claim 1, wherein said first housing has a body surrounded by said hood; and said second housing has a mating hood that can be fit in a gap between said body of said first housing and said hood thereof.

4. The lever-type connector of claim 3, wherein the lever is mounted on the first housing, and wherein the second housing has a cam pin engageable with the cam groove of the lever.

5. The lever-type connector of claim 4, further comprising a lock on the lever for engaging the first housing and releasably holding the lever at a position where the cam groove is aligned for receiving the cam pin.

6. The lever-type connector of claim 5, wherein the second housing includes a lock release for releasing the lock of the lever substantially when the cam pin enters the cam groove.

* * * * *